US007364274B2

(12) United States Patent
Kawabata et al.

(10) Patent No.: US 7,364,274 B2
(45) Date of Patent: Apr. 29, 2008

(54) DRIVING METHOD OF DROPLET EJECTION HEAD

(75) Inventors: Katuichi Kawabata, Yokohama (JP); Kazuo Asano, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 374 days.

(21) Appl. No.: 11/105,101

(22) Filed: Apr. 13, 2005

(65) Prior Publication Data

US 2005/0237366 A1 Oct. 27, 2005

(30) Foreign Application Priority Data

Apr. 23, 2004 (JP) ..... 2004-128220

(51) Int. Cl.
*B41J 2/045* (2006.01)

(52) U.S. Cl. ..... 347/69; 347/68

(58) Field of Classification Search ..... 347/68–72
See application file for complete search history.

(56) References Cited

U.S. PATENT DOCUMENTS 5,138,333 A 8/1992 Bartky et al.
5,689,291 A * 11/1997 Tence et al. ..... 347/10
6,318,845 B1 * 11/2001 Mizutani ..... 347/57
6,409,295 B1 * 6/2002 Norigoe ..... 347/11
6,951,376 B2 * 10/2005 Ishikawa ..... 347/11

FOREIGN PATENT DOCUMENTS

JP 2-215537 8/1990

* cited by examiner

*Primary Examiner*—Manish S. Shah
*Assistant Examiner*—Mark J Stevenosky, Jr.
(74) *Attorney, Agent, or Firm*—Cohen Pontani Lieberman & Pavane LLP

(57) ABSTRACT

A driving method of a droplet ejection head having plural channels separated by sidewalls formed with piezoelectric material, the channels being divided into three groups; and an electric voltage pulse is applied to each of the groups sequentially in a time-sharing mode, and to generate a shear deformation of the sidewall, and liquid is ejected as a droplet from a nozzle, wherein applying process of the pulse includes: a first step for enlarging a volume of a channel; a second step for keeping the enlarged volume; a third step for reducing the volume; a fourth step for keeping the reduced volume; and a fifth step for enlarging the volume, wherein the third step starts when $\alpha/\beta \leqq 1/3$ is satisfied for the protruded pillar at an adjoining channel nozzle driven just before; where $\alpha$ denotes a width of the pillar, and $\beta$ denotes a maximum width of the pillar.

24 Claims, 9 Drawing Sheets

PRIOR ART

DRIVING METHOD OF DROPLET EJECTION HEAD

This application is based on Japanese Patent Application No. 2004-18220 filed on Apr. 23, 2004 in Japanese Patent Office, the entire content of which is hereby incorporated by reference.

BACKGROUND OF THE INVENTION

The present invention relates to a driving method of droplet ejection head, and particularly to a driving method of droplet ejection head which is capable of suppressing bending tail of a droplet ejected from a nozzle, and improving landing accuracy of the droplet without decreasing drive frequency of the ejection head.

As an example of the droplet ejection head for ejecting liquid as a droplet from a nozzle, well known is an inkjet recording head that records an image by ejecting minute droplets onto a recording medium.

This type of inkjet head imposes pressure into a channel filled with ink, protrudes an ink pillar from the nozzle, after that, pulls back the tail edge of the protruded ink pillar by pulling in a meniscus, and separates the ink pillar from the meniscus. By this way, as shown in FIG. 13, the ink droplet 200 flies toward the recording medium 300 from the nozzle 400.

The ink droplet 200, just after ejected from the nozzle 400, has the main droplet 201 showing almost spherical shape and the tail portion 202 long extended from the end of the main droplet 201. However, after that, the tail portion separates to become second order droplets 203 so-called satellites. These main droplet 201 and second order droplets 203 fly toward the recording medium 300, and land to record an image. At this time, if the flying direction of the main droplet 201 and the flying direction of the second order droplets 203 are the same, they land at the same place to cause no bad effect on the image. However, if the flying direction of the second order droplets 203 differs from that of the main droplet 201, the second order droplets land around the main droplet 201 as shown in FIG. 13 to cause deterioration of the image.

The difference between the flying direction of the second order droplet 203 and the main droplet 201 is caused by generation of bending at the tail portion 202 of the ink droplet 200 just after the ejection from the nozzle 400, the bending direction being different from the originally expected direction shown by the arrow in FIG. 13.

The cause of the generation of bending at the tail portion of the ink droplet being ejected from the nozzle is known to be the irregularity of nozzle inner surface. For instance, as shown in FIG. 14, if inclination of the nozzle inner surface 401 is not uniform but differs at a certain portion, there arises an imbalance of the surface tension of meniscus M at the nozzle inner surface 401 to apply a biasing force that bends the tail portion 501 of the ink pillar 500 protruded from the nozzle 400, the biasing force being imposed to the direction perpendicular to the originally expected flying direction, thus the bending at the tail portion is generated just after the separation of the ink droplet from the meniscus. Therefore, accurateness in the shape of the nozzle inner surface affects greatly to a stable ink droplet ejection with suppressed tail bending of the ink droplet.

However, the accuracy level required to the nozzle inner shape is extremely high, and it is extremely difficult to manufacture the nozzle inner surface such that sectional shape of the nozzle inner surface is accurately circular and symmetrical about the center of the nozzle, therefore to satisfy the requirement is hardly possible. Further, if in usage a foreign material attaches to the nozzle inner surface, this being difficult to be removed, and this foreign material sometimes causes to generate the bending of the tail portion of the droplet. Therefore, it is required to stably eject a droplet without bending at the tail portion of the droplet by the other way than keeping accurate nozzle inner shape.

There has been studied to suppress the bending at the tail portion of the droplet. The Patent Document 1 discloses the technology where after protruding the ink pillar from the nozzle by imposing a first pulse, protruding the meniscus from the nozzle by imposing a second pulse before separation of the droplet in order to separate the droplet at the top of the convex shaped meniscus, and thereby prevents the bending of the tail portion.

(Patent Document 1)

Unexamined Japanese Patent Application Publication No. H2-215537

According to the technology described in the Patent Document 1, since the droplet is separated after the meniscus is protruded from the nozzle, the tail portion of the droplet is not affected by the nozzle inner surface shape. However, since other than the first pulse for protruding the ink pillar the second pulse for protruding the meniscus is further applied, the drive frequency is reduced, which leads to a problem of decreasing of recording rate. Further, since the next ejection cannot be started unless canceling the residual pressure wave, application of a new pulse to cancel the residual pressure wave is needed, and further reduce of the drive frequency is caused.

SUMMARY OF THE INVENTION

An object of the present invention is to provide an control method of droplet ejection head, which is capable of stably ejecting a droplet having no bending at the tail portion without lowering the drive frequency.

The above-mentioned object can be achieved by the control method of droplet ejection head having respective features described in the following items.

(1) A driving method of a droplet ejection head, the droplet ejection head comprising:

a plurality of channels separated by a sidewall, the sidewall comprising at least partially a piezoelectric material, the plurality of channels being divided into three groups of channels, where a group of channels in the three groups of channels comprises channels separated one another between which two channels of other groups are sandwiched; and an electrode formed on the sidewall, wherein an electric voltage pulse for ejecting a droplet is applied to drive each of the groups of channels sequentially in a time-sharing mode, and to cause a shear deformation of the sidewall, and by a pressure generated with the shear deformation liquid in a channel is ejected as a droplet from a nozzle, wherein the driving method of the droplet ejection head for applying the electric voltage pulse to eject the droplet comprises:

a first step for enlarging a volume of a channel in the group of channels;

a second step for keeping the enlarged volume;

a third step for reducing the volume of the channel to protrude a liquid pillar from a nozzle;

a fourth step for keeping a reduced volume; and a fifth step for enlarging the volume of the channel, wherein the third step starts when following condition is satisfied for a protruded liquid pillar from a nozzle of an adjoining channel, which is driven just before, and the protruded pillar is separated from a meniscus to be ejected as a droplet:

condition: $\alpha/\beta \leqq 1/3$, wherein $\alpha$ denotes a width of the protruded liquid pillar at a front edge of the opening in the nozzle, and $\beta$ denotes a maximum width of the protruded liquid pillar.

(2) The driving method of a droplet ejection head described in (1), wherein the third step starts when the meniscus, which is formed after the liquid pillar from the adjoining channel driven just before has been protruded, returns substantially to the front opening edge of the adjoining channel nozzle, and the protruded liquid pillar from the adjoining channel nozzle is separated from the meniscus to be ejected as the droplet.

(3) The driving method of a droplet ejection head described in (1) or (2), wherein a channel volume reduced by the third step is smaller than a channel volume before enlarging by the first step, and a channel volume enlarged by the fifth step is substantially same as the channel volume before enlarging by the first step.

(4) The driving method of a droplet ejection head described in (1) or (2), wherein when a (V) denotes an electric voltage to be applied onto the electrode formed on the sidewall in the first step, and b (V) denotes an electric voltage to be applied onto the electrode formed on the sidewall in the fifth step, $|a|>|b|$ is satisfied.

(5) The driving method of a droplet ejection head described in (4), wherein $|a|/|b|=2$ is substantially satisfied.

(6) A driving method of a droplet ejection head, the droplet ejection head comprising:

a plurality of channels separated by a sidewall, the sidewall comprising at least partially a piezoelectric material, the plurality of channels being divided into three groups of channels, where a group of channels in the three groups of channels comprises channels separated one another with two channels of other groups are sandwiched; and an electrode formed on the sidewall, wherein an electric voltage pulse for ejecting a droplet is applied to drive each of the groups of channels sequentially in a time-sharing mode, and to cause a shear deformation of the sidewall, and by a pressure generated with the shear deformation liquid in a channel is ejected as a droplet from a nozzle, wherein, an electric voltage pulse with a level such that a droplet is not ejected is applied onto an electrode formed on a sidewall of non-ejecting channel in the group of channels, and a micro vibration is given to a meniscus in the nozzle to the extent of not ejecting the droplet, wherein the driving method of the droplet ejection head for applying the electric voltage pulse with a level such that a droplet is not ejected comprises:

a first step for reducing a volume of a channel in the group of channels;

a second step for keeping the reduced volume;

a third step for enlarging the- volume of the channel, wherein the first step is started when a following condition is satisfied for a protruded liquid pillar from a nozzle of an adjoining channel, which is driven just before, and the protruded liquid pillar is separated from a meniscus to be ejected as a droplet:

condition: $\alpha/\beta \leqq 1/3$, wherein $\alpha$ denotes a width of the protruded liquid pillar at a front edge of the opening in the nozzle, and $\beta$ denotes a maximum width of the protruded liquid pillar.

(7) The driving method of a droplet ejection head described in (6), wherein a channel volume before reducing by the first step is substantially same as the channel volume after enlarging by the third step.

(8) A driving method of a droplet ejection head, the droplet ejection head comprising:

a plurality of channels separated by a sidewall, the sidewalls comprising at least partially a piezoelectric material, the plurality of channels being divided into three groups of channels, where each group of channels in the three groups of channels comprises channels separated one another with two channels of other groups; and an electrode formed on the sidewall, wherein an electric voltage pulse for ejecting a droplet is applied to drive each of the groups of channels sequentially in a time-sharing mode, and to cause a shear deformation of the sidewall, and by a pressure generated with the shear deformation a liquid in a channel in the group of channels is ejected as a droplet from a nozzle, wherein, an electric voltage pulse with a level such that a droplet is not ejected is applied onto an electrode formed on a sidewall of non-ejecting channel in the group of channels, and a micro vibration is given to a meniscus in the nozzle, wherein the driving method of the droplet ejection head for applying the electric voltage pulse with a level such that a droplet is not ejected comprising:

a first step for enlarging a volume of a channel in the group of channels;

a second step for keeping the enlarged volume;

a third step for reducing the volume of the channel, wherein the third step is started when a following condition is satisfied for a protruded liquid pillar from a nozzle of an adjoining channel, which is driven just before, and the protruded liquid pillar is separated from a meniscus to be ejected as a droplet:

condition: $\alpha/\beta \leqq 1/3$, wherein $\alpha$ denotes a width of the protruded liquid pillar at a front edge of the opening in the nozzle, and $\beta$ denotes a maximum width of the protruded liquid pillar.

(9) The driving method of a droplet ejection head described in (8), wherein a channel volume before enlarging by the first step is substantially same as the channel volume after reducing by the third step.

(10) The driving method of a droplet ejection head described in any one of (6)-(9), wherein duration of the second step is 2 AL, where AL denotes ½ of an acoustic resonance period of the channel.

(11) The driving method of a droplet ejection head described in any one of (6)-(10), wherein an electric voltage pulse with a level such that a droplet is not ejected is applied onto all electrodes formed on sidewalls regardless of non-ejecting channel or ejecting channel in the group of channels.

(12) The driving method of a droplet ejection head described in any one of (6)-(11), wherein a maximum protruding amount of the meniscus by the application of the electric voltage pulse with the level such that a droplet is not ejected is not greater than a nozzle radius.

(13) The driving method of a droplet ejection head described in any one of (1)-(12), wherein the electric voltage pulse is a rectangular wave pulse.

(14) The driving method of a droplet ejection head described in any one of (1)-(13), wherein viscosity of the liquid is not less than 5 cp and not greater than 15 cp.

(15) The driving method of a droplet ejection head described in any one of (1)-(14), wherein surface tension of the liquid is not less than 20 dyne/cm and not greater than 30 dyne/cm.

According to the present invention, a control method of droplet ejection head can be provided that is capable of stably ejecting a droplet having no bending at the tail portion without lowering the drive frequency.

BRIEF DESCRIPTION OF THE DRAWINGS

FIG. 1(*b*) is a schematic sectional view to show an example of a recording head.

DETAILED DESCRIPTION OF THE PREFERRED EMBODIMENT

In the following columns, embodiments of the present invention will be described based on drawings.

A driving method relating to the present invention can be utilized to any type of droplet ejection head having: a plurality of channels separated by a sidewall, the sidewalls being made of at least partially a piezoelectric material, the plurality of channels being divided into three groups of channels, where a group of channels in the three groups of channels includes ink channels between which two other channels are sandwiched, and an electrode formed on the sidewall, wherein an electric voltage pulse for ejecting a droplet is applied to drive each of the groups of channels sequentially in a time-sharing mode, and to cause a shear deformation of the sidewall, and by a pressure generated with the shear deformation liquid in a channel is ejected as a droplet from a nozzle. And, the liquid in the channel to be ejected may be any type of liquid. However, in the following description, a shear mode type inkjet recording head (hereinafter merely called as a recording head) is used which is a droplet ejection head using image recording ink as the liquid in the channel.

Figure 1:
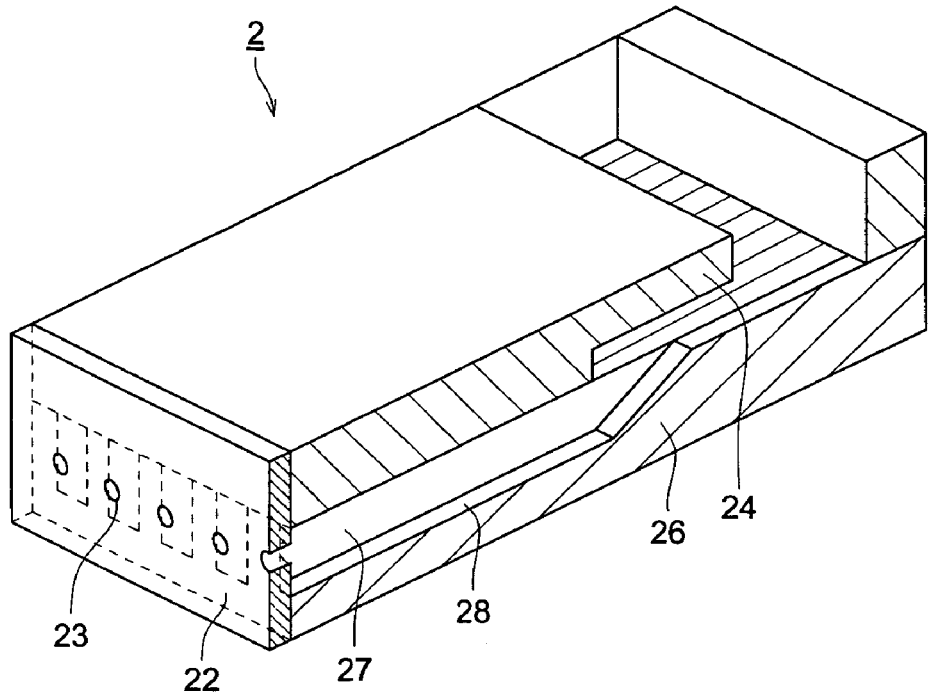
FIG. 1(*a*) is a schematic perspective view to show an example of a recording head partially with sectional view.
Figure 1:
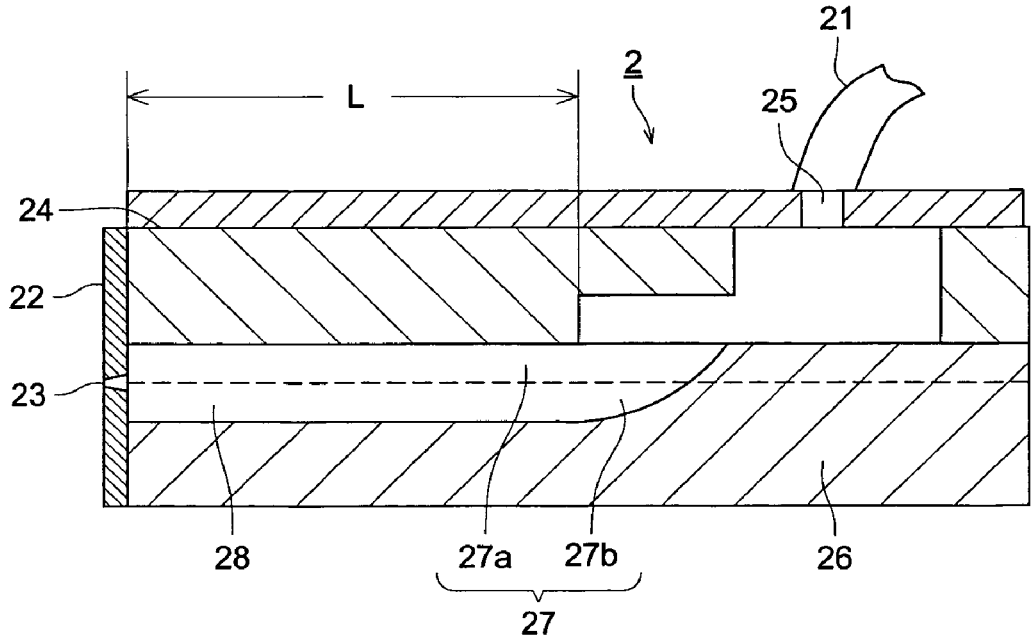
Figure 2:
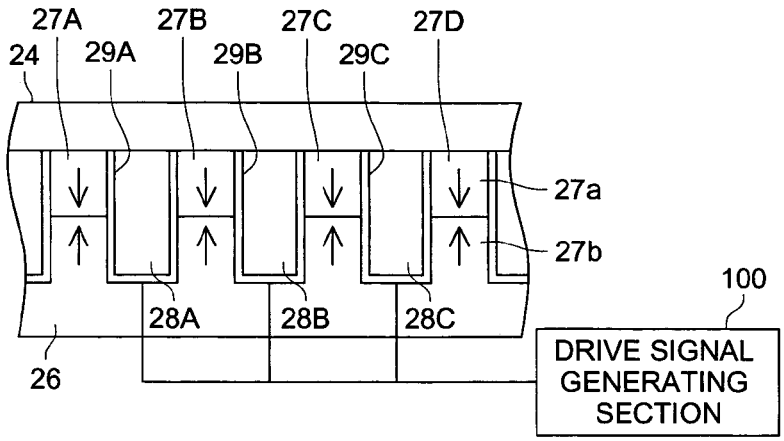
FIGS. 2(*a*)-2(*c*) are drawings to show the movement of a recording head when ejecting ink.
Figure 2:
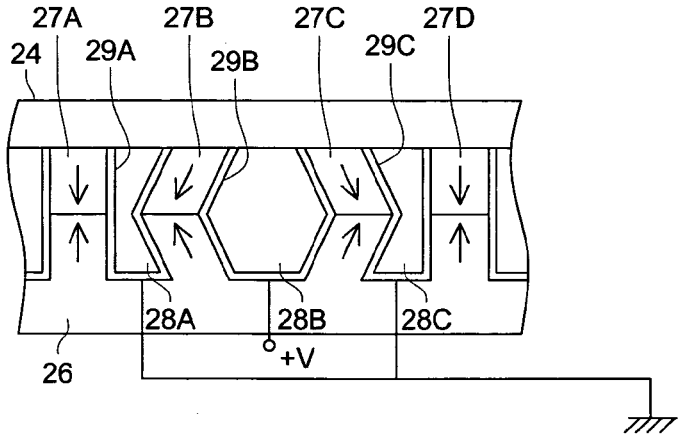
Figure 2:
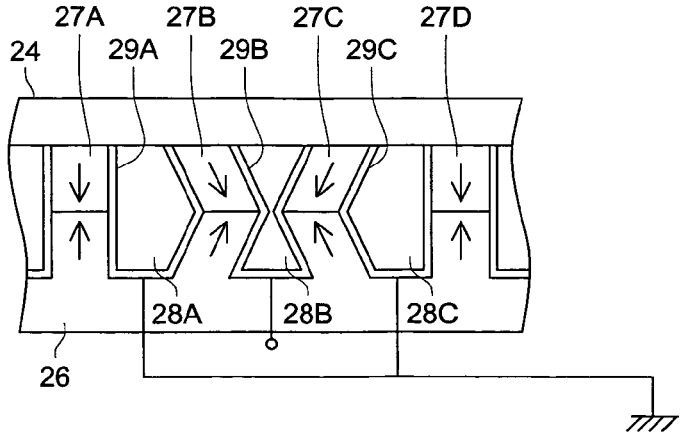

FIG. 1(*a*) and FIG. 1(*b*) are schematic construction views showing a shear mode type recording head, FIG. 1(*a*) is a perspective view showing one plane with a sectional view, and FIG. 1(*b*) is a sectional view. FIGS. 2(*a*)-2(*c*) are drawings to show the movement of the recording head.

The recording head 2 is provided with many channels 28 between the cover plate 24 and the base plate 26, the channels being separated by plural sidewalls 27A, 27B, and 27C made of piezoelectric material such as PZT. In FIGS. 2(*a*)-2(*c*), three channels (28A, 28B, 28C) are shown, which are parts of the many channels 28. One end of the channel 28 is connected to the nozzle 23 formed at the nozzle forming member 22, and the other end is connected to the ink tank (not illustrated) with the tube 21 via the ink supply port 25. On the surface of sidewall 27, the electrodes 29A, 29B, and 29C are closely formed so as to connect the upper side of the both sidewalls over to the bottom face in the channel 28. Each of the electrodes 29A, 29B, and 29C is connected to the drive signal generating section 100.

The drive signal generating section 100 has a drive signal generating circuit to generate a series of drive signals including plural electric voltage pulses for each pixel period, and a drive signal selecting circuit to select the electric voltage pulse according to each pixel data among the drive signals supplied from the drive signal generating circuit and to supply to each channel, and the drive signal generating section supplies electric voltage signals for driving the sidewall 27 made of the piezoelectric material according to each pixel data. The electric voltage pulse includes the ejection pulse for ejecting the ink, and the micro vibration pulse for vibrating the meniscus within the level not to eject the ink droplet from the nozzle 23.

Although each sidewall 27, in this example, is constructed with two piezoelectric members 27*a* and 27*b* whose polarization direction are different with each other as shown by arrows in FIGS. 2(*a*)-(*c*), the piezoelectric member may be used only for the portion denoted by 27 a for example, and may be provided at least partially on the sidewall 27.

When the electric voltage pulse as the ejection pulse is applied by the control of the drive signal generating section 100 onto the electrodes 29A, 29B, and 29C closely formed on each sidewall 27, the ink droplet is ejected from the nozzle 23 with the movement exemplified below. In FIGS. 2(*a*)-2(*c*), the nozzle is omitted.

Figure 3:
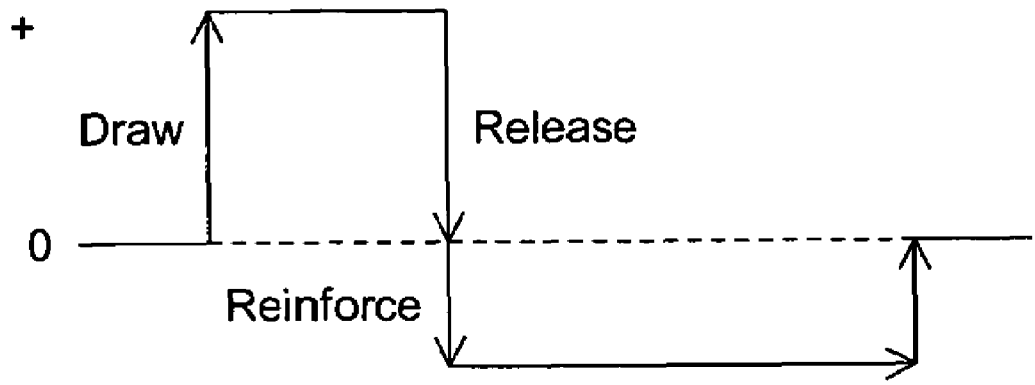
FIG. 3 is a drawing of waveform showing an example of ejection pulse.

When no electric voltage pulse is applied onto any of the electrodes 29A, 29B, or 29C, any of the sidewalls 27A, 27B, or 27C is not deformed. When under the status shown by FIG. 2(*a*), the electric voltage pulse shown in FIG. 3 is applied onto the electrode 29B in addition that the electrodes 29A and 29C are grounded, firstly electric fields is generated in a direction perpendicular to the polarizing direction of the piezoelectric member constructing the sidewalls 27B and 27C, in each of the sidewalls 27B and 27C a shear deformation is generated at each joint surface between piezoelectric member 27*a* and 27*b*, the sidewalls 27B and 27C are deformed outward with each other, and the volume of the channel 28B is enlarged. By this process, negative pressure is generated in the channel 28 to let the ink flow in (Draw).

After maintaining this status for a certain period, when the voltage of the electric voltage pulse is put back to zero, the sidewalls 27B and 27C returns to the neutral position shown in FIG. 2(*a*) from the enlarged position shown in FIG. 2(*b*), and high pressure is imposed to the ink in the channel 28B (Release). Subsequently, by applying an electric pulse such that the sidewalls 27B and 27C is deformed in opposite direction as shown in FIG. 2(*c*), the volume of the channel 28B is reduced (Reinforce) to generate positive pressure in the channel 28B. By this process, the meniscus in the nozzle formed with the ink filled in the channel 28B changes to the direction of protruding, and an ink pillar is ejected from the nozzle. Each of the other channels moves in the same manner as described above.

This driving method is called as DRR drive method, and is the typical driving method for the shear mode type recording head.

In this way, in cases where the plural channels 28 separated by the sidewalls 27, which are at least partially formed with a piezoelectric material, are driven, when the sidewall 27 of one of the channels 28 is deformed, the adjoining channel 28 is affected. Therefore, in the plural channels 28, the channels, separated with each other such that between each of the channels two other channels are sandwiched, are united to form one group of the channels. In this manner, the channels 28 are divided into three groups, and each group of channels is driven sequentially with a time-sharing mode (hereinafter this driving method may be called as three cycle drive). In this type of drive method where each group of channels is driven sequentially with a time-sharing mode, the drive method is adopted where, after the applying of electric voltage pulse to one group of channels has finished, the electric voltage pulse is applied onto the next group of channels adjoining said one group of channels.

Figure 4:
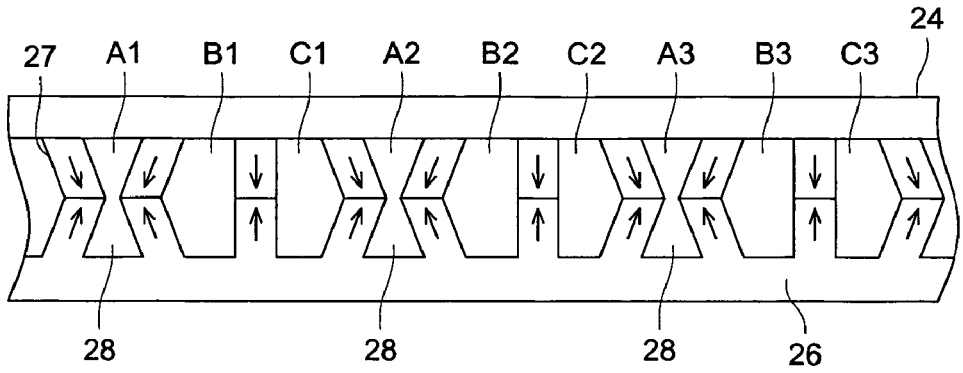
FIGS. 4(*a*)-(*c*) are drawings to show the movement of a recording head being driven in a time-shearing mode.
Figure 4:
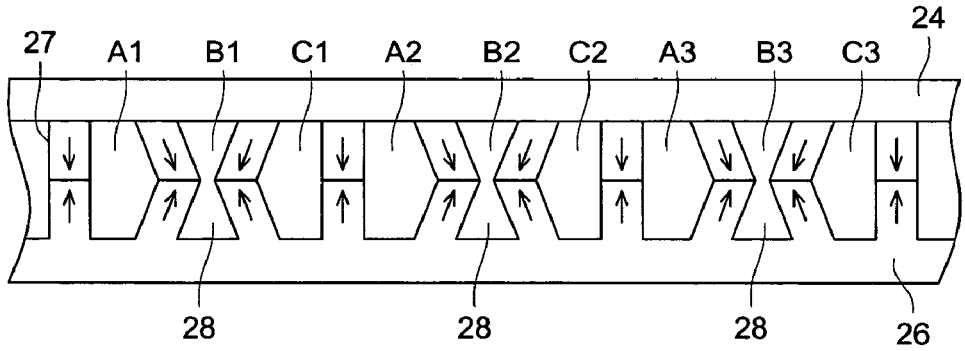
Figure 4:
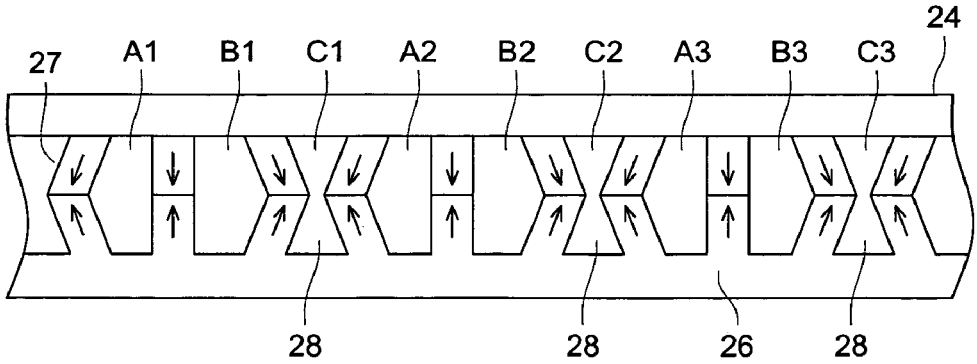
Figure 5:
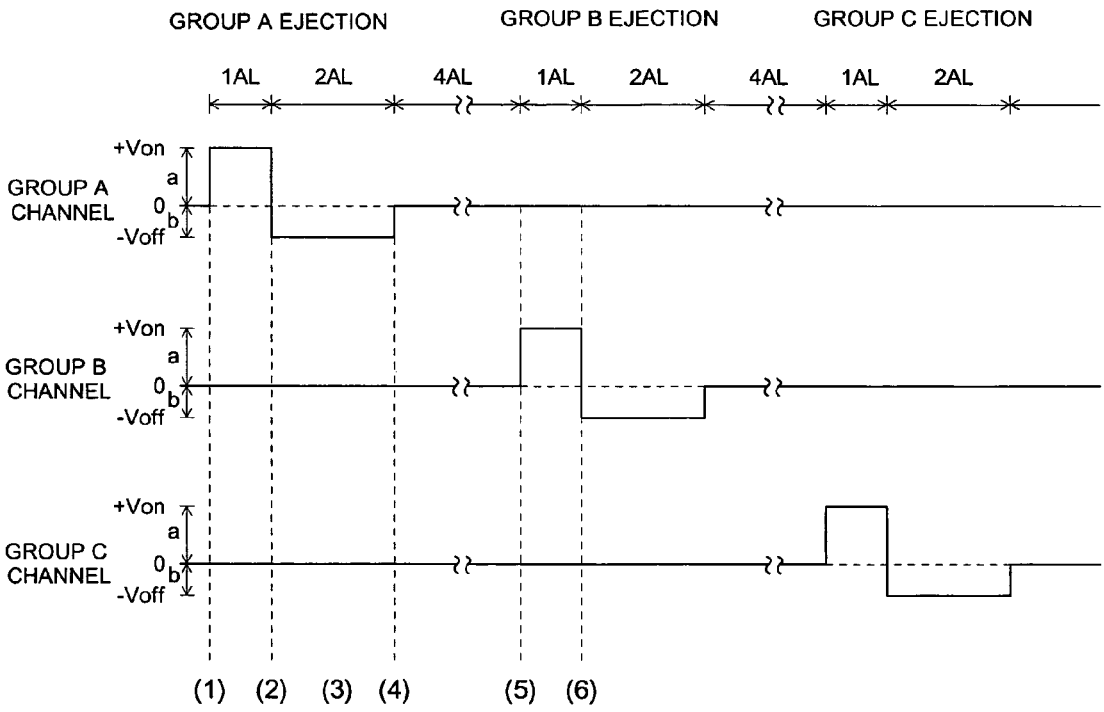
FIG. 5 is a time chart of ejection pulses being applied onto channels in each of the groups A, B and C.
Figure 6:
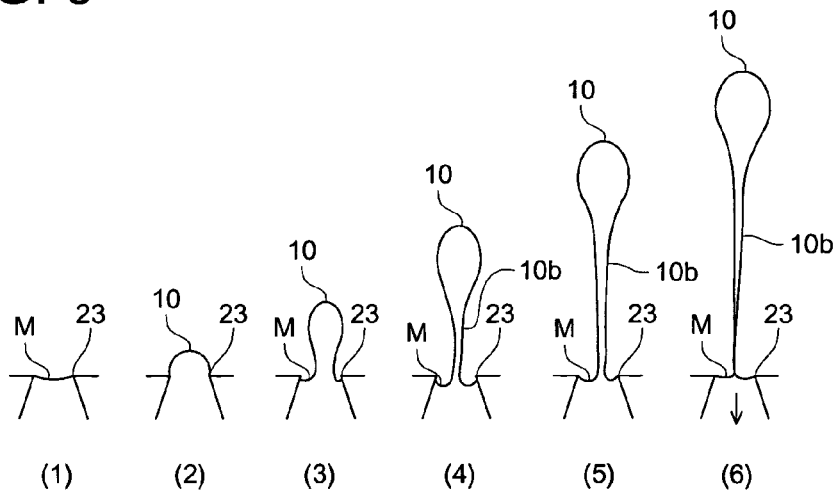
FIG. 6 is a schematic drawing to show the behaviors of ink and meniscus at a nozzle belonging to the group A channel shown in FIG. 5.

The driving method of the present invention for performing the above-mentioned three cycle drive will be further described by using FIG. 4. The example shown in FIG. 4 is described by assuming that the recording head is structured by nine channels of 28, A1, B1, C1, A2, B2, C2, A3, B3, C3. Further, one example of timing chart for electric voltage pulse to be applied on channel 28 of each of A, B, and C groups is shown in FIG. 5. The behavior of the ink and meniscus at the nozzle 23 of channel 28 in group A shown in FIG. 5 is schematically illustrated in FIG. 6. Each of the numeric numbers (1)-(6) in FIG. 5, FIG. 6 and in the following explanations corresponds with each other.

Incidentally, in the present specification, "liquid pillar" or "ink pillar" means the liquid or the ink in a condition that its front edge is protruded from the nozzle opening, but the rear edge is still connected to and not separated from the meniscus in the nozzle. And "droplet" or "ink droplet" means the liquid or the ink whose rear edge is separated from the meniscus.

Further in the shear mode type recording head, since the deformation of the sidewall 27 is generated by the electric potential difference applied on the electrode 29 on both sides of the sidewall, instead of applying a negative voltage pulse on the electrode 29 in the ink ejecting channel 28, grounding the electrode 29 in the ink ejecting channel 28 as well as applying an positive voltage pulse on the electrode 29 on both sides adjoining channels can cause the same performance. According to this way, the drive can be performed by applying only positive voltage on the channel 28. However, in the present specification, the embodiment is described where the ink head is driven with both of positive and negative voltages.

Herein, the electric voltage pulse to be applied on channel 28 of each group for ejecting the ink droplet, the ejection pulse, is the pulse for the above described DRR drive method. The DRR drive method contains the first step for enlarging the volume of the channel 28, the second step for maintaining the condition of enlarged volume, the third step for protruding the ink pillar from the nozzle 23 by reducing the volume of the channel 28, the fourth step for maintaining the condition of reduced volume of the channel 28, and the fifth step for enlarging the volume of the channel 28.

(1) Firstly, applying an ejection pulse on the electrode of each channel in the group A (A1, A2, A3) and grounding the electrodes in the both adjoining channels. Namely, when a positive voltage pulse (+Von) is applied to the sidewall 27 of the channel 28 in the group A, which is supposed to eject the ink, the sidewall 27 deforms outward to enlarge the volume of channel 28 (the first step of the group A). By this operation, a negative pressure is generated in the channel 28 and by this negative pressure, the ink from the ink tank flow into the channel 28 in the group A.

When the driving waveform does not change, the pressure in the channel 28 repeats inversion in every 1 AL. Then, the enlarged volume status of the channel 28 generated by the application of the positive voltage pulse is maintained for the period of 1 AL (the second step of the group A). And the meniscus M which have been drawn in moves toward the front edge of the nozzle 23, and the ink pressure reverses to positive.

Incidentally, AL (Acoustic Length) is defined to be ½ of an acoustic resonance period of a channel. While measuring the speed of ejected ink droplet with applying rectangular voltage pulses on the sidewall 27 made of piezoelectric material, the AL is obtained as the pulse width that makes a flying speed of ink droplet maximum when the pulse width is varied with a constant voltage value of the rectangular wave. The pulse means a rectangular wave with a constant voltage wave height. When the wave height voltage is assumed 100% and 0 V is assume as 0%, the pulse width is defined as the time period between the time of 10% rise from 0 V and the time of 10% decay from the wave height voltage. Further, the rectangular wave here means a waveform whose rise time and decay time from 10% to 90% of voltage are not greater than ½ AL, and preferably not greater than ¼ AL.

(2) As described above, when the electrode is grounded at the timing after maintaining the enlarged volume status of the channel during the period of 1 AL, the deformation of the sidewall 27 returns to the original state to reduce the volume of the channel 28 in the group A, this causes to impose a high pressure onto the ink in the channel 28 and to protrude the ink pillar from the nozzle 23. Further, when a negative voltage pulse (−Voff) is applied at the same timing to the electrode 29 of each channel 28 in the group A, as shown in FIG. 4(*a*) the sidewall deforms inward to reduce the volume of the channel 28 in the group A. This causes to impose a further high pressure on the ink to further protrude the ink pillar 10 from the nozzle 23 (the third step of the group A).

(3) The status of reduced volume of the channel 28 is maintained during the period of 2 AL (the fourth step of the group A). After the first 1 AL, the pressure inverts to impose a negative pressure in the channel 28, and when another 1 AL elapses the pressure in the channel 28 invert again to be a positive pressure and at this time the meniscus M in the nozzle 23 moves toward the front edge of the opening in the nozzle 23.

(4) After that, when the electrode is grounded the deformation of the sidewall 27 returns to the original state to enlarge again the volume of the channel 28 in the state of reduced volume (the fifth step of the group A). At this time, the residual pressure wave in each channel 28 in the group A is canceled. At this moment, the ink pillar 10 is not yet separated from the meniscus M and the tail portion 10*b* is still connected to the meniscus M.

After the ejection pulses according to the steps from the first to the fifth have been applied to each channel 28 of the group A, in succession, the ejection pulses according to the steps from the first step to the fifth step are applied to each of the channel 28 in group B (B1, B2, B3), which is adjoining to each channel 28 in the group A.

FIG. 5 shows an example where an application of the ejection pulse to each channel 28 in group B starts with the first step of the ejection pulse after 4 AL from the completion of application of the ejection pulse to the each channel 28 in the group A, at this timing the ink pillar 10 protruded from the nozzle 23 of each channel 28 in the group A being not yet separated from the meniscus M. Incidentally, at the time 5 AL elapsed after the completion of application of the ejection pulse to the each channel 28 in the group A, the meniscus M, which is formed after the ink pillar 10 is protruded from the nozzle 23 of each channel 28 in the group A, returns substantially to the front edge of the opening in the nozzle 23 (hereinafter the front edge of the opening in the nozzle 23 may be referred as "return position" of the meniscus M).

(5) After the drive of each channel 28 in the group A, at the time when the ink pillar 10 protruded from the nozzle 23 of each channel 28 in the group A is not yet separated from the meniscus M, the ejection pulse is applied to the electrode 29 of the adjoining each channel 28 in group B, and the electrode 29 of the both sides adjoining channels is grounded. Namely when a positive voltage pulse (+Von) is applied to the channel 28 in group B, sidewall 27 of the channel 28 which is supposed to eject the ink in group B deforms outward to enlarge the volume of channel 28 (the first step of group B).

At this time, a sidewall 27 at one side of each channel 28 in the group A adjoining to each channel 28 in group B deforms to reduce the volume of each channel 28 in the group A, then the meniscus M in nozzle 23 of each channel 28 in the group A is imposed a pressure to the ejecting direction of nozzle 23, with the state that the tail portion 10*b* of the ink pillar 10 is connected, and the meniscus M moves swiftly to the vicinity of the front edge of the opening in the nozzle 23.

(6) After that, maintaining the enlarging volume status of the channel 28 in group B during the period of 1 AL (the second step of group B), and when the electrode 29 is grounded at the timing the deformation of the sidewall 27 returns to the original state to reduce the volume of the channel 28 in group B, this causes to impose a high pressure onto the ink in the channel 28 in group B. Further at this timing, when a negative voltage pulse (−Voff) is applied on the electrode 29 of each channel 28 in group B, as shown in FIG. 4(*b*) the sidewall deforms inward to further reduce the volume of the channel 28 in group B (the third step of group B).

The third step of group B starts before the ink pillar 10 protruded from the nozzle 23 of each channel 28 in the group A being separated from the meniscus M and being ejected as an ink droplet. At this time, as shown with enlargement in FIG. 11, the ink pillar 10 protruded from each channel 28 in the group A is formed with the main droplet 10*a* which is largely protruded from the nozzle 23 and the tail portion 10*b* which has a long tail extended from the rear end of the main droplet 10*a*, the tail being connected to the meniscus M in the nozzle 23, wherein when $\alpha$ (μm) denotes a width of the ink pillar at the front edge of the opening in the nozzle 23, and $\beta$ (μm) denotes the maximum width of the ink pillar, the condition of $\alpha/\beta \leqq 1/3$ is satisfied at this time.

Then, due to the reduction of the volume of each channel 28 in the group B at the third step, as shown in FIG. 4(*b*), the volume of the each channel 28 in the group A adjoining to the group B is enlarged and the meniscus M in the nozzle 23 of each channel 28 in the group A moves toward the direction to be drawn into the nozzle 23. By this draw-in operation of the meniscus M, a pull-in forth is imposed onto the tail portion 10*b* of the ink pillar 10 protruded from the nozzle 23 of each channel 28 in the group A in the direction opposite to the ejecting direction. And the ink pillar 10 is separated from the meniscus M in the nozzle 23, and the ink droplet is ejected from the nozzle 23 in the each channel 28 in the group A.

After that, the group C (C1, C2, C3) adjoining to the group B is also driven as shown in FIG. 4(*c*), and further, the group A adjoining to the group C is driven in the same manner as described above. In other words, the third step of the group C starts before the ink pillar 10 is separated from the meniscus M, the ink pillar being protruded from the nozzle 23 of each channel 28 in the adjoining the group B which is driven just before. And when the third step of the group C starts the status of the ink pillar 10 satisfies the condition of $\alpha/\beta \leqq 1/3$, therefore, due to the reduction of the volume of each channel 28 in the group C, as shown in FIG. 4(*c*), the volume of the each channel 28 in the group B is enlarged and the meniscus M in the nozzle 23 of each channel 28 in the group B moves toward the direction to be drawn into the nozzle 23. The third step of the group A starts before the ink pillar 10 is separated from the meniscus M, the ink pillar being protruded from the nozzle 23 of each channel 28 in the adjoining group C which is driven just before. And when the third step of the group A starts, the status of the ink pillar 10 satisfies the condition of $\alpha/\beta \leqq 1/3$, therefore, due to the reduction of the volume of each channel 28 in the group A, as shown in FIG. 4(*a*), the volume of the each channel 28 in the group C is enlarged and the meniscus M in the nozzle 23 of each channel 28 in the group C moves toward the direction to be drawn into the nozzle 23. Therefore, a pull-in forth is imposed onto the tail portion 10*b* of the ink pillar 10 protruded from the nozzle 23 of each channel 28 in the group B and C, and the ink and the meniscus in the nozzle 23 of the each channel 28 in the group B and C behaves in the same way described above.

In this way, the third step to apply the voltage for ejecting the ink droplet by reducing the volume of the channel 28 is started before the ink pillar 10 is separated from the meniscus M, the ink pillar being protruded from the nozzle 23 of the adjoining channel 28 which is driven just before. And the third step starts when the status of the ink pillar 10 satisfies the condition of $\alpha/\beta \leqq 1/3$, therefore, by the third step, the volume of the adjoining channel 28 driven just before enlarges to impose the pull-in force, and by this pull-in force the bending at the tail portion 10*b* of the ink pillar 10 is straitened. Namely, in the condition of $\alpha/\beta \leqq 1/3$, the rear end of the tail portion 10*b*, connected to the meniscus M, of the ink pillar 10 is sufficiently thin. The thinned tail portion 10*b* is easy to be bent, and by the pull-in of the meniscus the tail portion 10*b* can be straitened, and immediately after that, the tail portion 10*b* is separated to realize the stable ink droplet ejection without bending at the tail portion. With this reason, an ineffectual operation for the three cycle drive is not required, accordingly, the drive for preventing the bending at tail portion of the ink droplet is possible without lowering the drive frequency.

Due to the fifth step to enlarge the volume of channel 28 that is conducted subsequently to the fourth step to maintain the condition of reduced volume of the channel 28, the residual pressure wave is canceled, and this generally causes the delay for the meniscus M in the nozzle 23 to return to the front edge of the opening. However, according to the present invention, due to the first step to enlarge the volume of the channel 28, which is driven prior to the third step, the volume reducing pressure is generated on the adjoining channel 28 driven just before, and the meniscus M in the nozzle 23 is protruded toward the ejecting direction of the nozzle 23 to make the meniscus M return to the front edge of the opening of the nozzle 23. This results in suppressing the bending at the tail portion of the ink droplet.

In cases where $\alpha/\beta>1/3$, the tail portion 10*b* of the ink pillar 10 is too thick, and even when the meniscus M is drawn in, the tail portion 10*b* of the ink pillar 10 is not immediately separated but separated after the ink pillar 10 is thinned with the elapse of time. During the time, with receiving the influence of the imbalance of surface tension at the meniscus M, bending occurs at the connecting potion of the meniscus M and the tail portion 10*b* of the ink pillar 10, and the ink pillar 10 is separated in that shape. This bending cannot be straitened with the draw-in of the meniscus M, and the tail portion of the ejected ink droplet is easy to be bent.

However, the lower limit of $\alpha$ is preferable to satisfy the relation of $\alpha/\beta>1/10$ for effectively controlling the bending of the tail portion 10*b*. If $\alpha$ is too small, the tail portion 10*b* may be straitened to some extent, however it has a possibility to be separated before sufficiently straitened.

Measurement of the width of $\alpha$ and $\beta$ of the ink pillar 10 can be performed by the strobe measurement using CCD camera of the ink pillar protruded from the opening of the nozzle 23.

According to the example shown in FIG. 5, application of the ejection pulse to each channel 28 in the group B is conducted such a timing that the first step of the ejection pulse starts after the completion of applying the ejection pulse to each channel 28 in the group A, and after the period of 4 AL when the ink pillar 10 protruded from the nozzle 23 of each channel 28 in the group A is not yet separated from the meniscus M. At this time, the third step is started at the timing when the meniscus M, formed after the ink pillar protruded from the nozzle 23 of each channel 28 in the adjoining group, which is driven just before, returned substantially to the return position in addition that the condition of $\alpha/\beta\leqq 1/3$ is satisfied. Then, the ink pillar 10 protruded from the nozzle 23 of the adjoining channel 28 is separated from the meniscus M to be ejected as the ink droplet. Therefore, at the time when the tail portion 10*b* of the ink pillar 10 is separated from the meniscus M, the ink pillar 10 is not affected by the inner shape of the nozzle 23, and the tail portion of the ink droplet has few possibility of deflecting to the different direction from the flying direction. This enhances the effect of suppressing the bending at the tail portion, and leads to increased drive frequency and improvement of accuracy of the ink landing position.

Figure 11:
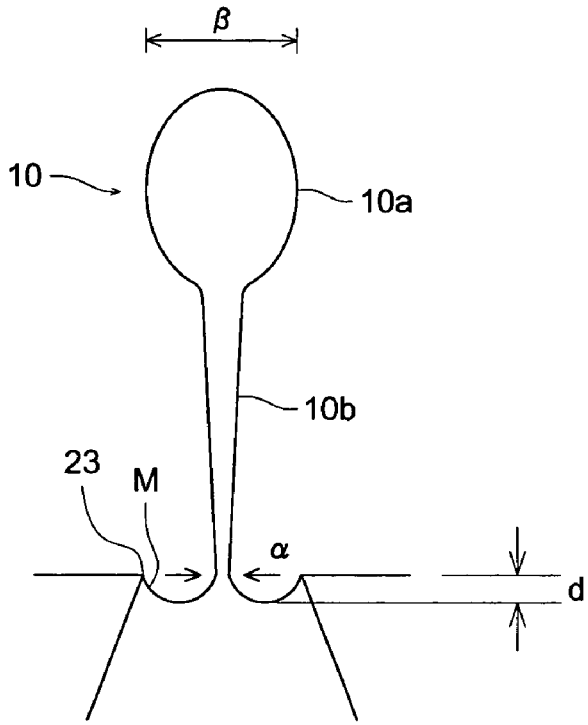
FIG. 11 is a schematic view of an ink pillar.

Incidentally, "the time when the meniscus M returned substantially to the return position" means the time when the meniscus M, at the time after the ink pillar 10 has protruded, positions approximately at the return position or at the position protruded from the front edge of the opening of the nozzle 23. This "positions approximately at the returned position" means the condition where the distance "d", as shown in FIG. 11, from the meniscus M to the return position is ½ of nozzle radius or less, and preferably ¼ of the nozzle radius. The case where the meniscus M is positions approximately at the return position in this way is more preferable than the case where the meniscus M is protruded from the front edge of the opening of the nozzle 23, from the point that the drive frequency is possible to be increased. Incidentally, shape of the opening of the nozzle 23 is not limited to a perfect circle but can be various shapes including an ellipse and the like. The nozzle radius in the present invention means ½ of the longest major axis in the front edge face of the opening of ejecting side of the nozzle 23.

In the present embodiment where the drive by the ejection pulse includes the first step to the fifth step, in cases where the volume of the channel 28 being reduced by the third step for reducing the volume of the channel 28 to protrude the ink pillar 10 from the nozzle 23 is smaller than the volume of channel 28 before being enlarged by the first step, and also the volume of the channel 28 being enlarged by the fifth step is same as the volume of channel 28 before being enlarged by the first step, the driving waveform of the ejection pulse can be made simple waveform as shown in FIG. 5. Further, according to this ejection pulse the sidewall 27 returns to the initial state at the final fifth step of the successive steps, and since the residual pressure wave generated at the third step is effectively cancelled by the fifth step, it is preferable for performing a high frequency drive.

Further, when the voltage to be applied on the electrode 29 formed at the sidewall 27 in the first step is assumed as a (V), and the voltage to be applied on the electrode 29 formed at the sidewall 27 in the fifth step is assumed as b (V), by making to satisfy the relation $|a|>|b|$ as shown in FIG. 5, returning of the meniscus becomes fast to be preferable for performing the high frequency drive. Herein, each of the voltage "a" and the voltage "b" indicates a differential voltage from zero level.

By making the voltage "a" and the voltage "b" approximately satisfy the relation of $|a|/|b|=2$, the residual pressure wave generated at the third step is effectively cancelled by the fifth step, and this is preferable because of satisfying both of the high frequency drive and the stable ejection.

Next, a drive method will be described where a micro vibration is imposed to the meniscus M in the nozzle 23 without ejecting the ink droplet, wherein in the case of three cycle drive, the electrode 29 formed on the sidewall 27 of the non-ejecting channel 28 in one group of channel 28 is applied a voltage pulse for imposing micro vibration (micro vibration pulse) to the meniscus M in the level of not ejecting the ink droplet.

Figure 7:
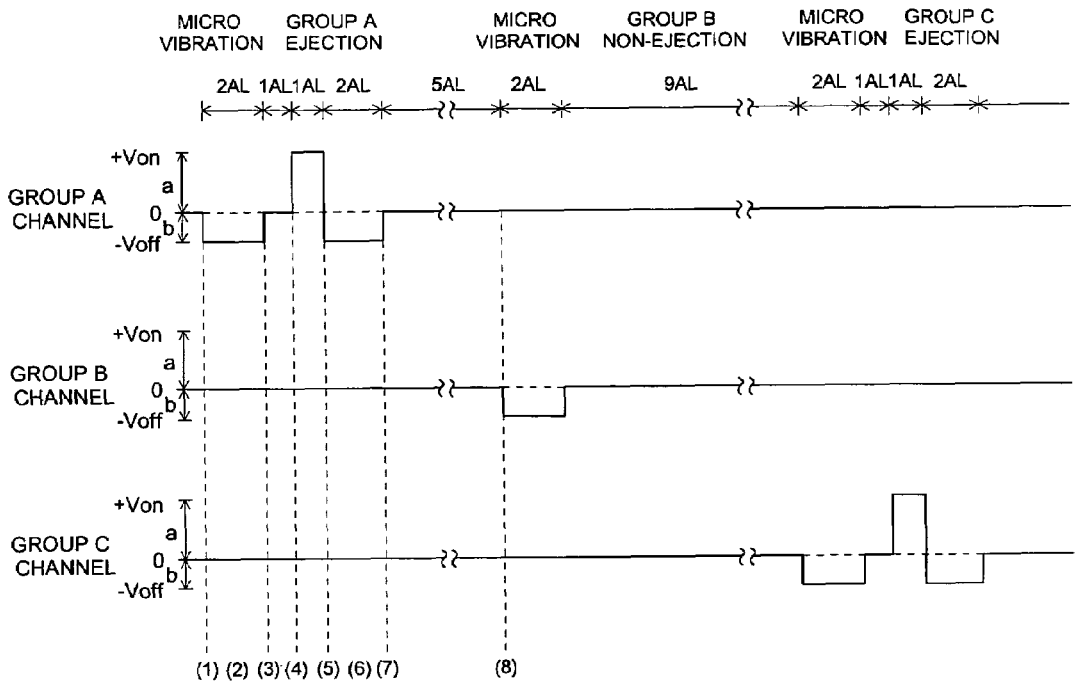
FIG. 7 shows time charts of micro vibration pulse and ejection pulse being applied onto channels in each of the groups A, B and C.
Figure 8:
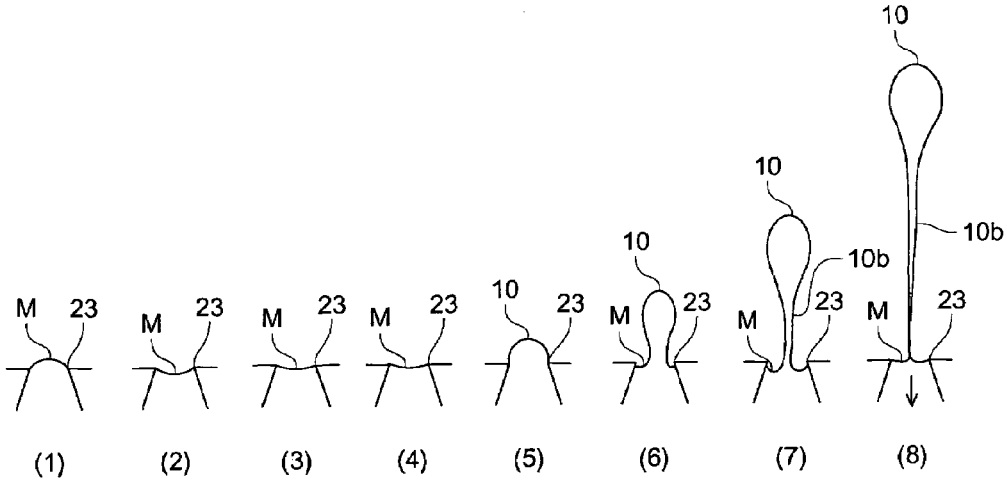
FIG. 8 is a schematic drawing to show the behaviors of ink and meniscus at a nozzle belonging to the group A channel shown in FIG. 7.

FIG. 7 shows a time chart of voltage pulse (ejection pulse and the micro vibration pulse) in one example of driving method. The status of the ink and the meniscus in the nozzle of channel 28 in the group A, corresponding to the time chart of FIG. 7, is schematically shown in FIG. 8. The numeric numbers in (1) to (8) correspond respectively with each other in FIG. 7, FIG. 8 and in the description below.

The voltage pulse as the micro vibration pulse to be applied on each channel 28 in each group for giving micro vibration to the meniscus M in the nozzle 23 without ejecting the ink droplet includes the first step for reducing the volume of the channel 28, the second step for maintaining the reduced state, and the third step for enlarging the volume of the channel 28.

(1) Firstly, applying a micro vibration pulse on the electrode 29 of each channel 28 in the group A (A1, A2, A3) and grounding the electrodes 29 in the both adjoining channels. Namely, when a negative voltage pulse (−Voff) is applied, the sidewall 27 of the channel 28 in the group A deforms inward to reduce the volume of channel 28 (the first step of the group A). By this operation, a positive pressure is generated in the channel 28 and by this positive pressure, the meniscus M in the nozzle 23 of the channel 28 in the group A is protruded from the opening of the nozzle 23 to the extent of not being ejected.

(2) When the driving waveform does not change, the pressure in the channel 28 repeats inversion in every 1 AL. Then, the reduced volume status of the channel 28 generated by the application of the negative voltage pulse is maintained for the period of 2 AL (the second step of the group A). And the meniscus M, which has been protruded moves toward the front edge of the nozzle 23 after once drawn into the nozzle 23.

(3) After that, when the channel 28 in the group A is grounded the deformation of the sidewall 27 of the channel 28 in the group A returns to the original state to enlarge the volume of the channel 28 (the third step of the group A). Then, a negative pressure is generated in the channel, and due to this negative pressure, the meniscus M in the nozzle 23 of each channel 28 in the group A is drawn into the nozzle 23. By this successive application of the micro vibration pulses through the first step to the third step, the meniscus M in the nozzle 23 is imposed micro vibrations with the level of not causing the ejection of the ink droplet.

After applying this micro vibration pulse, an ejection pulse is applied to each channel 28 in the group A based on image data. The ejection pulse here is the same ejection pulse as the one exemplified in FIG. 5.

(4) After the period of 1 AL from completion of micro vibration application, when a positive voltage pulse (+Von) is applied as the ejection pulse, the sidewall 27 of the channel 28, which is supposed to ejecting the ink, in the group A is deformed to enlarge the volume of the channel 28.

(5) After maintaining the enlarged volume status during the period of 1 AL, when the electrode 29 is grounded the deformation of the sidewall 27 returns to the original state to reduce the volume of the channel 28 in the group A, this causes to impose a high pressure onto the ink in the channel 28 in the group A to protrude the ink pillar 10 from the nozzle 23. Further at this timing, when a negative voltage pulse (−Voff) is applied on the electrode 29 of each channel 28 in group A, the sidewall 27 deforms inward to further reduce the volume of the channel 28 to impose a further high pressure onto the ink, and to further protrude the ink pillar 10 from the nozzle.

(6) While the status of reduced volume of the channel 28 is maintained during the period of 2 AL, after the first 1 AL, the pressure inverts to cause a negative pressure in the channel 28, and when another 1 AL elapses the pressure in the channel 28 inverts again to be a positive pressure and at this time the meniscus M in the nozzle 23 moves toward the front edge of the opening in the nozzle 23.

(7) After that, when the electrode 29 of each channel 28 in the group A is grounded the deformation of the sidewall 27 returns to the original state to enlarge again the volume of the channel 28. At this time, the residual pressure wave is canceled. At this moment, the ink pillar 10 is not yet separated from the meniscus M and the tail portion 10*b* is still connected to the meniscus M.

After the micro vibration pulses have been applied to each channel 28 of the group A as described above, in succession, the micro vibration pulses and the ejection pulses are applied to each of the channel 28 in group B (B1, B2, B3), which is adjoining to each channel 28 in the group A. The ejection pulse is applied based on the image data, and FIG. 7 shows the case where the ejection pulse is not applied to each of the channel 28 in the group B.

FIG. 7 shows an example where application of the micro vibration pulse to each channel 28 in the group B starts 5 AL after the completion of application of the ejection pulse to the each channel 28 in the group A, at this timing the ink pillar 10 protruded from the nozzle 23 of each channel 28 in the group A being not yet separated from the meniscus M.

(8) After the drive of each channel 28 in the group A, at the time when the ink pillar 10 protruded from the nozzle 23 of each channel 28 in the group A is not yet separated from the meniscus M, when the negative voltage pulse (−Voff) is applied to each channel 28 in group B, sidewall 27 of the channel 28 in the group B deforms inward to reduce the volume of channel 28 (the first step of group B).

At this time, the sidewall 27 at one side of each channel 28 in the group A adjoining to each channel 28 in group B deforms to enlarge the volume of each channel 28 in the group A. The first step of group B starts before the ink pillar 10 protruded from the nozzle 23 of each channel 28 in the group A being separated from the meniscus M and being ejected as an ink droplet. At this time, as shown with enlargement in FIG. 11, the ink pillar 10 protruded from each channel 28 in the group A is formed with the main droplet 10*a* which is largely protruded from the nozzle 23 and the tail portion 10*b* which has a long tail extended from the rear end of the main droplet 10*a*, the tail being connected to the meniscus M in the nozzle 23. Wherein when $\alpha$ (μm) denotes a width of the ink pillar at the front edge of the opening in the nozzle 23, and $\beta$ (μm) denotes the maximum width of the ink pillar, the condition of $\alpha/\beta \leqq 1/3$ is satisfied at this time.

Then, due to the reduction of the volume of each channel 28 in the group B at the first step of the micro vibration pulse, the volume of the each channel 28 in the group A adjoining to the group B is enlarged and the meniscus M in the nozzle 23 of each channel 28 in the group A moves toward the direction to be drawn into the nozzle 23. By this draw-in operation of the meniscus M, a pull-in forth is imposed onto the tail portion 10*b* of the ink pillar 10 protruded from the nozzle 23 of each channel 28 in the group A in the direction opposite to the ejecting direction. And the ink pillar 10 is separated from the meniscus M in the nozzle 23, and the ink droplet is ejected from the nozzle 23 in the each channel 28 in the group A.

After that, the group C (C1, C2, C3) adjoining to the group B, and the group A adjoining to the group C are also respectively driven as described above. In this example, the group B is supposed to be non-ejection, and the ejecting process of the group B is omitted. The first step of the micro vibration pulse to be applied to each of the channel 28 in the group A starts before the ink pillar 10 is separated from the meniscus M, the ink pillar being protruded from the nozzle 23 of each channel 28 in the adjoining the group C which is driven just before. And when the first step of the micro vibration pulse starts, the status of the ink pillar 10 satisfies the condition of $\alpha/\beta \leqq 1/3$, therefore, due to the enlargement of the volume of each channel 28 in the group C, the meniscus M in the nozzle 23 of each channel 28 in the group C moves toward the direction to be drawn into the nozzle 23. And, a pull-in forth is imposed onto the tail portion 10*b* of the ink pillar 10 protruded from the nozzle 23 of each channel 28 in the group C, and the ink and the meniscus in the nozzle 23 of the each channel 28 in the group C behaves in the same way described above.

In this way, the reduction of the volume of channel 28 due to the first step of the micro vibration pulse is started before the ink pillar 10 is separated from the meniscus M, the ink pillar being protruded from the nozzle 23 of the adjoining channel 28 which is driven just before. And when it starts, the status of the ink pillar 10 satisfies the condition of $\alpha/\beta \leqq 1/3$, therefore, the volume of the adjoining channel 28 driven just before enlarges to impose the pull-in force, and by this pull-in force the bending at the tail portion 10*b* of the ink pillar 10 is straitened. Namely, in the condition of $\alpha/\beta \leqq 1/3$, the rear end of the tail portion 10*b*, connected to the meniscus M, of the ink pillar is sufficiently thin. The thinned tail portion 10*b* is easy to be bent, and by the pull-in of the meniscus M the tail portion 10*b* can be straitened, and immediately after that, the tail portion 10*b* is separated to realize the stable ink droplet ejection without bending at the tail portion. By this, an ineffectual operation for the three cycle drive is not required, accordingly, the drive for preventing the bending at tail portion of the ink droplet is possible without lowering the drive frequency.

Further, due to utilizing the micro-vibration pulse, even the non-ejecting channel can prevent the bending at the tail portion of the ink pillar. Therefore, the above-described effect can be attained regardless to image data. Further, as the micro vibration is imposed to the meniscus M, clogging at the nozzles 23 can be suppressed.

In cases where $\alpha/\beta > 1/3$, the tail portion 10*b* of the ink pillar 10 is too thick, and even when the meniscus M is drawn in, the tail portion lob of the ink pillar 10 is not immediately separated but separated after the ink pillar 10 is thinned with the elapse of time. During the time, with receiving the influence of the imbalance of surface tension at the meniscus M, bending occurs at the connecting potion of the meniscus M and the tail portion 10*b* of the ink pillar 10, and the ink pillar 10 is separated in that shape. Thus the bending cannot be straitened with the draw-in of the meniscus M, and the tail portion of the ejected ink droplet is easy to be bent.

However, the lower limit of a is preferable to satisfy the relation of $\alpha/\beta > 1/10$ for effectively controlling the bending of the tail portion 10*b*. If $\alpha$ is too small, the tail portion 10*b* may be straitened to some extent, however it has a possibility to be separated before sufficiently straitened.

Measurement method of the width of $\alpha$ and $\beta$ is same as describe above.

In this micro vibration pulse, it is preferable to make the volume of the channel 28 before being reduced by the first step same as the volume of the channel 28 after being enlarged by the third step, because each vibration pulse can be simple in waveform as shown in FIG. 7. Further, this micro vibration pulse is preferable in high frequency drive, since the sidewall 27 returns to the initial state at the third step, which being the last step in the series of micro vibration steps.

Incidentally, in the example shown in FIG. 7, the micro vibration pulse is exemplified to includes the first step to reduce the volume of the channel 28, the second step to maintain the state of reducing the volume, and the third step to enlarge the volume of the channel 28, however, the micro vibration pulse can be utilized that includes the first step to enlarge the volume of the channel 28, the second step to maintain the state of enlarging the volume, and the third step to reduce the volume of the channel 28.

Figure 9:
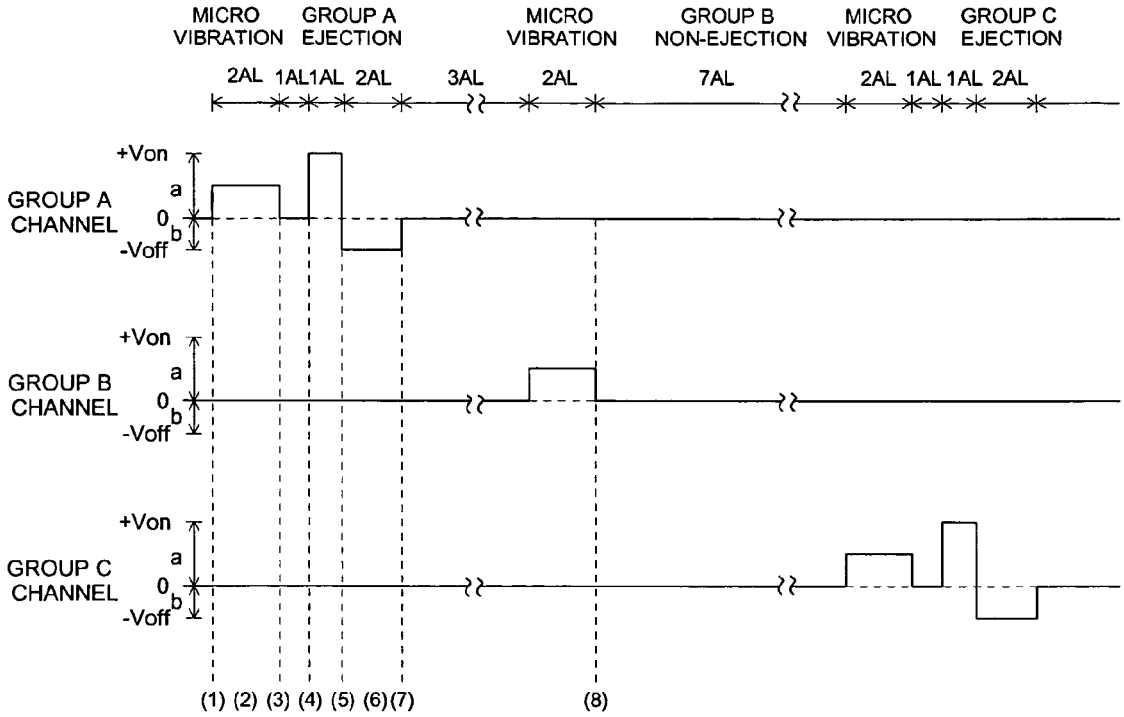
FIG. 9 shows another example of time charts of micro vibration pulse and ejection pulse being applied onto channels in each of the groups A, B and C.
Figure 10:
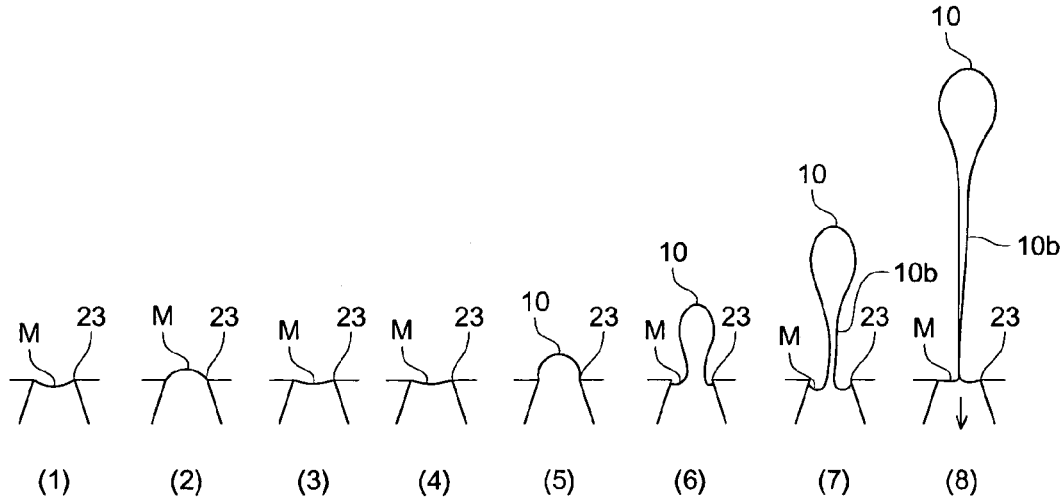
FIG. 10 is a schematic drawing to show the behaviors of ink and meniscus at a nozzle belonging to the group A channel shown in FIG. 9.

An example of embodiment utilizing the latter micro vibration pulse is shown in FIG. 9. The status of the ink and the meniscus in the nozzle 23 of channel 28 in the group A shown in FIG. 9 is schematically shown in FIG. 10. The numeric numbers in (1) to (8) correspond respectively with each other in FIG. 9 and FIG. 10. In this case, each channel 28 in the group B is also assumed to be non-ejecting channel.

According to this micro vibration pulse, since the channel 28 performs enlarging—maintaining—reducing movement, the meniscus M behaves as shown (1)-(3) in FIG. 10, which is the reverse movement to the case where the micro vibration pulse shown in FIG. 7 is applied. In the case of applying this micro vibration pulse, in the example of applying to the channel 28 in the group B, the timing of applying the third step of the micro vibration pulse to reduce the volume of each channel 28 in the group B is set at the time after the ejection pulse is applied to the channel 28 in the group A, before the ink pillar 10 protruded from the nozzle 23 of each channel in the group A separates from the meniscus M, and when width $\alpha$ and $\beta$ of the ink pillar 10 protruded from each channel 28 in the group A satisfy the condition of $\alpha/\beta \leqq 1/3$. By this, the volume of the adjoining channel 28 driven jut before enlarges, and a pull-in forth is imposed onto the tail portion 10*b* of the ink pillar 10 protruded from the nozzle 23 of each channel 28, and by this pull-in force, bending of the tail portion 10*b* of the ink pillar 10 is corrected. This causes the similar effect as in the case where the micro vibration pulse shown in FIG. 7 is applied.

Also in this micro vibration pulse, it is preferable to make the volume of the channel 28 before being enlarged by the first step same as the volume of the channel 28 after being reduced by the third step, because each vibration pulse can be simple in waveform as shown in FIG. 9. Further, this micro vibration pulse is preferable in high frequency drive, since the sidewall 27 returns to the initial state at the third step, which being the last step in the series of micro vibration steps.

As shown in FIG. 7 and FIG. 9 the micro vibration pulse has 2 AL for continuing period of the second step, which maintains the reduced state or the enlarged state of the volume of the channel 28. This is preferable from the point of high frequency drive since the residual pressure wave generated in the first step can be easily canceled.

In the example shown in FIG. 7 and FIG. 9, the micro vibration pulse is applied regardless of ejection or non-ejection. This is preferable, since in the channel 28 for conducting the recording by ejecting the ink, the ink droplet can be surely ejected after the micro vibration is imposed on the meniscus M in the nozzle 23. And also, as described above, by the first step or the third step of the micro vibration, bending of the tail portion of ink droplet, which is to be ejected from the adjoining channel, can be prevented. Further, it is possible to apply the micro vibration pulse only onto the non-ejecting channel 28. In this case, power consumption and heat generation from the recording head can be suppressed.

When imposing the micro vibration to the meniscus M, it is preferable to make the maximum protruding amount of the meniscus M less than the radius of the nozzle 23. In the case where the protruding amount of the meniscus M is large, the meniscus M cannot return to the return position until the timing of the immediately succeeding ink ejection, and this causes difficulty of stable ejection. While, by making the protruding amount of the meniscus M less than the radius of the nozzle 23, stable ejection becomes possible even just after imposing the micro vibration to the meniscus M.

Figure 12:
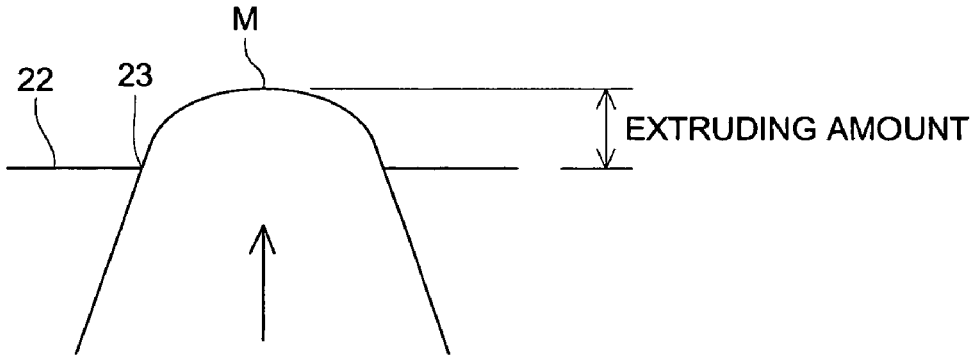
FIG. 12 is a schematic drawing to show the protruding (extruding) amount of a meniscus.
Figure 13:
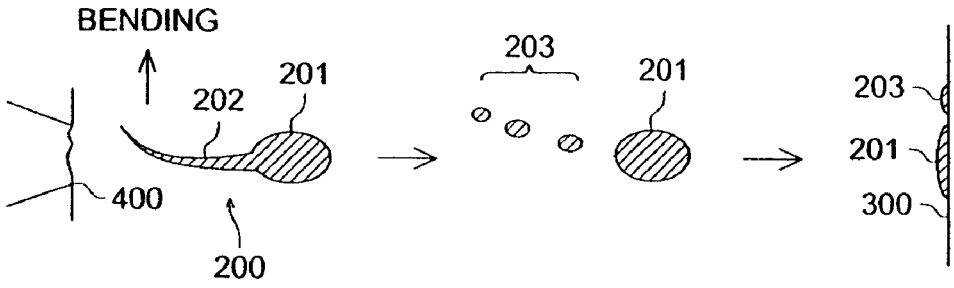
FIG. 13 is an explanatory drawing to show an ink droplet flying behavior in a prior art.
Figure 14:
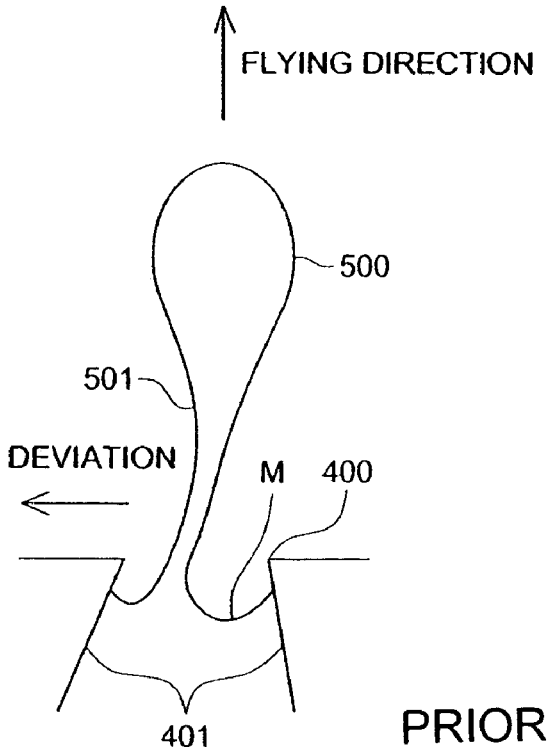
PRIOR ART FIG. 14
FIG. 14 is a schematic drawing showing an appearance of an ink pillar protruded from a nozzle in a prior art.

Incidentally, the maximum protruding amount means the maximum value of the protruding amount of the meniscus M from the front edge of the opening at the nozzle 23, when the meniscus M is protruded by one time protruding movement. The protruding amount of the meniscus M can be measured by strobe synchronization with using the digital micro scope "VH-6300" made by KEYENCE CORPORATION, for example. As shown in FIG. 12, the protruding amount is the measured value of the protruding amount of the meniscus M from the front edge of the opening in the nozzle 23 at approximately central portion of the nozzle 23, measured in approximately vertical direction to the nozzle forming member 22.

In the present invention, voltage pulses as the ejection pulse and the micro vibration pulse to be applied to the electrode 29 of each channel 28 are preferably rectangular wave pulses as shown in figures. The rectangular wave pulse can generate more extreme deformation of the sidewall 27 than the trapezoid wave, which has sloped voltage rise and decay, and by the rectangular wave pulse of reducing the volume of the channel 28 a strong expanding pressure is generated at the adjoining channel 28, this enables realization of sure separation of the ink droplet. Further the rectangular wave can be easily formed by a simple digital circuit, this leads to a merit of simplification of circuit structure comparing to the trapezoid wave.

The driving method of the present invention achieves a remarkable suppressing effect of the bending at the tail portion in cases where the ink viscosity is not less than 5 cp and not more than 15 cp. Because, the ink of this condition has high viscosity, has small fluctuation due to the residual wave in the process of returning of the meniscus M, and has a tendency that the ink pillar 10 is hard to be separated from the meniscus M, and the tail portion 10*b* is likely to extend long, causing easy generation of the bending at the tail portion 10*b*.

Further, the driving method of the present invention also achieves a remarkable effect in cases where the surface tension of the ink is not less than 20 dyne/cm and not more than 30 dyne/cm. Because, the ink of this condition has low surface tension, and has a tendency that the ink pillar 10 is hard to be separated from the meniscus M, and the tail portion 10*b* is also likely to extend long, causing easy generation of the bending at the tail portion 10*b*.

Incidentally, the application timings of the ejection pulse and the micro vibration pulse shown in FIGS. 5, 7, and 9 are only examples. Since likeliness of the ink pillar 10 to become thin is different with each recording head or each of the ink, it is preferable in this invention to examine the moving mode of the meniscus at the opening edge of the nozzle, which is the return position of the meniscus, by the observation of the meniscus movement of the actual recording head or by a simulation using, for example, a finite element method, and to adjust the timing of applying signals by the use of electrical circuit.

EXAMPLE OF THE EMBODIMENT

Effect of the present invention will be described below.

Example 1

The shear mode type recording head was used as the droplet ejecting head.

Specifications:

Nozzle pitch: 180 dpi
Nozzle diameter: 30 μm
Volume of the ejecting ink droplet: 15 pl
Ink: oil-based pigment ink
Viscosity at 25° C.: 7 cp
Surface tension at 25° C.: 28 dyne/cm Ejection Pulse:

The ejection pulse shown in FIG. 5 for the DDR method is used.

Ratio of the first step voltage to the fifth step voltage of the ejection pulse (|a|/|b|): 2/1

The maintaining time of the second step of the ejection pulse: 1 AL

The maintaining time of the fourth step of the ejection pulse: 2 AL

Method of Evaluation

In the three-cycle drive method, the interval of the ejection pulse is set to be 2 AL, the interval being a period from the finish of the fifth step of ejection pulse for immediately prior cycle to the start of the first step of ejection pulse. And generation of the bending at the tail portion of the ejected ink droplet is observed and evaluated using the following criteria.

VG: No bending was observed at all,
G: Almost no bending was observed,
NG: Considerable degree of bending was observed.

Example 2

The interval of the ejection pulse is set to be 3 AL in the three-cycle drive method, and the bending was evaluated with other conditions being same as those of the example 1.

Example 3

The interval of the ejection pulse is set to be 4 AL in the three-cycle drive method, and the bending was evaluated with other conditions being same as those of the example 1.

Comparative Example 1

The interval of the ejection pulse is set to be 6 AL in the three-cycle drive method, and the bending was evaluated with other conditions being same as those of the example 1.

Table 1 shows the results of the above observations and evaluations for the examples 1 to 3 and the comparative example 1.

Incidentally, occurrence of the generation of the bending at the tail portion of the ink droplet was observed visually by using a CCD camera. Existence of the bending was judged as whether the tail edge portion of the ink droplet just prior to separation from the meniscus being parallel to the flying direction of the ink droplet.

In the Table 1, "Separation of the ink droplet" indicates whether the ink pillar, protruded from the nozzle of the adjoining channel in the immediately prior cycle, is separated from the meniscus and ejected as an ink droplet, at the start timing of the third step of the ejection pulse.

Further, in the Table 1, "Ratio of the ink pillar width" indicates the ratio the ink pillar width α (μm) at the edge of the nozzle opening to the maximum width β (μm) of the ink pillar α/β, at the start timing of the third step of the ejection pulse.

TABLE 1

| | Interval of ejection pulse | Separation of the ink droplet | Ratio of ink pillar width | Bending of the tail portion |
|---|---|---|---|---|
| Example 1 | 2 AL | not separated | 1/4 | G |
| Example 2 | 3 AL | not separated | 1/5 | G |
| Example 3 | 4 AL | not separated | 1/8 | VG |
| Comparative example | 6 AL | separated | | NG |

As in the examples 1 to 3, in the cases where before the separation of the ink droplet, the third step of the ejection cycle next to the adjoining channel starts with satisfying the condition of $\alpha/\beta \leqq 1/3$, the bending at the tail portion was not observed at all or hardly observed, and preferable ink droplet ejection was performed. In the example 3, at the start timing of the third step, the meniscus of the ink pillar protruded in immediately prior cycle from the nozzle of the adjoining channel has returned substantially to the opening edge of the nozzle, therefore, the bending of the tail portion was not observed at all.

On the other hand, in the comparative example 1, the third step of the ejection pulse started after the ink droplet from the nozzle in the adjoining channel driven just before has separated, and since the ratio of the pillar width did not satisfy the condition of $\alpha/\beta \leqq 1/3$, the tail portion of the ink pillar protruded from the nozzle could not be corrected by the draw in of the meniscus, and the bending was generated in the ejected ink droplet with being affected by the inner shape of the nozzle.

Example 4

A recording head same as that of the example 1 is used. The micro vibration pulse and the ejection pulse shown in FIG. 7 for the DDR method are used, and each voltage pulse is selected according to the image data (micro vibration pulse at the time of non-recording, micro vibration pulse and ejection pulse at the time of recording), to conduct the three-cycle drive. The ejection pulse is same as that of the example 1.

Method of Evaluation

In the three-cycle drive method, the interval of the ejection pulse is set to be 1 AL, the interval being a period from the finish of the fifth step of the ejection pulse for just prior cycle to the start of the first step of the ejection pulse. And generation of the bending at the tail portion of the ejected ink droplet is observed and evaluated using the above-described criteria.

Example 5

The interval of the ejection pulse is set to be 3 AL in the three-cycle drive method, and the bending was evaluated with other conditions being same as those of the example 4.

Example 6

The interval of the ejection pulse is set to be 5 AL in the three-cycle drive method, and the bending was evaluated with other conditions being same as those of the example 4.

Comparative Example 2

The interval of the ejection pulse is set to be 7 AL in the three-cycle drive method, and the bending was evaluated with other conditions being same as those of the example 4.

Table 2 shows the results of the observations and evaluations for the examples 4 to 6 and the comparative example 2.

In the Table 2, "Separation of the ink droplet" indicates whether the ink pillar, protruded from the nozzle of the adjoining channel in the immediately prior cycle, is separated from the meniscus and ejected as an ink droplet, at the start timing of the first step of the micro vibration pulse.

Further, in the Table 2, "Ratio of the ink pillar width" indicates the ratio the ink pillar width $\alpha$(μm) at the edge of the nozzle opening to the maximum width $\beta$ (μm) of the ink pillar $\alpha/\beta$, at the start timing of the first step of the micro vibration pulse.

TABLE 2

| | Interval of ejection pulse | Separation of the ink droplet | Ratio of ink pillar width | Bending of the tail portion |
|---|---|---|---|---|
| Example 1 | 1 AL | not separated | 1/3 | G |
| Example 2 | 3 AL | not separated | 1/4 | G |
| Example 3 | 5 AL | not separated | 1/8 | G |
| Comparative example | 7 AL | separated | | NG |

As in the examples 4 to 6, in the cases where before the separation of the ink droplet, the first step of the micro vibration pulse cycle next to the adjoining channel cycle starts with satisfying the condition of $\alpha/\beta \leqq 1/3$, the bending at the tail portion was not observed at all or hardly observed, and preferable ink droplet ejection was performed.

On the other hand, in the comparative example 2, the first step of the micro vibration pulse started after the ink droplet from the nozzle in the adjoining channel driven just before has separated, and since the ratio of the pillar width did not satisfy the condition of $\alpha/\beta \leqq 1/3$, the tail portion of the ink pillar protruded from the nozzle could not be corrected by the draw in of the meniscus, and the bending was generated in the ejected ink droplet by being affected by the inner shape of the nozzle.

What is claimed is:

1. A driving method of a droplet ejection head, the droplet ejection head comprising:

a plurality of channels, each of the plurality of channels being separated by a sidewall, each of the sidewalls comprising at least partially a piezoelectric material, the plurality of channels being divided into three groups comprising a first group of channels, a second group of channels, and a third group of channels, and each group of channels in the three groups of channels comprising channels physically separated from one another and between which two channels of the other groups of channels are disposed;

a nozzle having an opening for ejecting liquid; and an electrode formed on a sidewall of each group of channels;

wherein the driving method of the droplet ejection head comprises:

applying an electric voltage pulse to the electrode of each group of channels, one group of channels at a time, for driving each of the three groups of channels sequentially in a time-sharing mode;

generating a shear deformation of the sidewall of each group of channels; and ejecting liquid from a channel of the plurality of channels as a droplet from the nozzle by a pressure generated with the shear deformation of the sidewall, wherein the step of applying the electric voltage pulse to the electrodes of each group of channels, one group of channels at a time, comprises:

a first step for enlarging a volume of a channel in the group of channels;

a second step for keeping a state of the volume enlarged;

a third step for reducing the volume of the channel to protrude a liquid pillar from the nozzle;

a fourth step for keeping a status of the volume reduced; and a fifth step for enlarging the volume of the channel, wherein the third step for the second group of channels starts when a condition $\alpha/\beta<1/3$ is satisfied for the protruded pillar at a nozzle of an adjoining channel in the first group of channels previously driven, and separates the protruded pillar from a meniscus to eject the protruded pillar as a droplet, and wherein $\alpha$ denotes a width of the protruded liquid pillar at a front edge of the opening in the nozzle, and $\beta$ denotes a maximum width of the protruded liquid pillar.

2. The driving method of the droplet ejection head described in claim 1, wherein the third step for the second group of channels starts when the meniscus which is formed after the liquid pillar has been protruded from the nozzle of the adjoining channel in the first group of channels previously driven, returns substantially to the front edge of the opening of the adjoining channel nozzle, and the protruded liquid pillar from the nozzle of the adjoining channel is separated from the meniscus to be ejected as the droplet.

3. The driving method of the droplet ejection head described in claim 1, wherein a first volume of the channel reduced by the third step is smaller than a second volume of the channel before being enlarged by the first step, and a third volume of the channel enlarged by the fifth step is substantially same as the second volume of the channel before being enlarged by the first step.

4. The driving method of the droplet ejection head described in claim 1, wherein when a (V) denotes a first electric voltage to be applied to the electrode in the first step, and b (V) denotes a second electric voltage to be applied to the electrode in the fifth step, and a relation of $|a|>|b|$ is satisfied.

5. The driving method of the droplet ejection head described in claim 4, wherein a relation of $|a|/|b|=2$ is approximately satisfied.

6. A driving method of a droplet ejection head, the droplet ejection head comprising:

a plurality of channels, each of the plurality of channels being separated by a sidewall, each of the sidewalls comprising at least partially a piezoelectric material, the plurality of channels being divided into three groups comprising a first group of channels, a second group of channels, and a third group of channels, and each group of channels in the three groups of channels comprising channels physically separated from one another and between which two channels of the other groups of channels are disposed;

a nozzle having an opening for ejecting liquid; and an electrode formed on a sidewall of each group of channels;

wherein the driving method of the droplet ejection head comprises:

applying a first electric voltage pulse to the electrode of each group of channels, one group of channels at a time, for driving each of the three groups of channels sequentially in a time-sharing mode;

generating a shear deformation of the sidewall of each group of channels; and ejecting liquid from a channel of the plurality of channels as a droplet from the nozzle by a pressure generated with the shear deformation of the sidewall, and applying a second electric voltage pulse to the electrode of each group of non-ejecting channels, the second electric voltage pulse having a voltage level that prevents ejection of, a droplet to impose a micro vibration onto a meniscus in the nozzle to prevent ejection of droplet, wherein the process of applying the second electric voltage pulse to the electrode of each group of non-ejecting channels comprises:

a first step for reducing a volume of a channel in the group of channels;

a second step for keeping a state of the volume reduced;

a third step for enlarging the volume of the channel, wherein the first step for the second group of channels starts when a condition $\alpha/\beta<1/3$is satisfied for a protruded pillar at a nozzle of an adjoining channel in the first group of channels previously driven by the first electric voltage pulse, and separates the protruded pillar from a meniscus to eject the protruded pillar as a droplet, and wherein $\alpha$ denotes a width of the protruded liquid pillar at a front edge of the opening in the nozzle, and $\beta$ denotes a maximum width of the protruded liquid pillar.

7. The driving method of the droplet ejection head described in claim 6, wherein a first volume of the channel before being reduced by the first step is substantially the same as a second volume of the channel after being enlarged by the third step.

8. A driving method of a droplet ejection head, the droplet ejection head comprising:

a plurality of channels, each of the plurality of channels being separated by a sidewall, each of the sidewalls comprising at least partially a piezoelectric material, the plurality of channels being divided into three groups comprising a first group of channels, a second group of channels, and a third group of channels, and each group of channels in the three groups of channels comprising channels physically separated from one another and between which two channels of the other groups of channels are disposed;

a nozzle having an opening for ejecting liquid; and an electrode formed on a sidewall of each group of channels;

wherein the driving method of the droplet ejection head comprises:

applying a first electric voltage pulse to the electrode of each group of channels, one group of channels at a time, for driving each of the three groups of channels sequentially in a time-sharing mode;

generating a shear deformation of the sidewall of each group of channels; and ejecting liquid from a channel of the plurality of channels as a droplet from the nozzle by a pressure generated with the shear deformation of the sidewall, and applying a second electric voltage pulse to the electrode of each group of non-ejecting channels, the second electric voltage pulse having a voltage level that prevents ejection of a droplet, to impose a micro vibration onto a meniscus in the nozzle to prevent ejection of the droplet, wherein the process of applying the second electric voltage pulse to the electrode of each group of non-ejecting channels comprises:

a first step for reducing a volume of a channel in the group of channels;

a second step for keeping a state of the volume reduced;

a third step for enlarging the volume of the channel, wherein the third step for the second group of channels starts when a condition $\alpha/\beta<1/3$ is satisfied for a protruded pillar at a nozzle of an adjoining channel in the first group of channels previously driven by the first electric voltage pulse, and separates the protruded pillar from a meniscus eject. the protruded pillars as a droplet, and wherein $\alpha$ denotes a width of the protruded liquid pillar at a front edge of the opening in the nozzle, and $\beta$ denotes a maximum width of the protruded liquid pillar.

9. The driving method of the droplet ejection head described in claim 8, wherein a first volume of the channel before being enlarged by the first step is substantially same as a second volume of the channel after being reduced by the third step.

10. The driving method of the droplet ejection head described in claim 6, wherein duration of the second step is 2 AL, where AL denotes ½ of an acoustic resonance period of the channel.

11. The driving method of the droplet ejection head described in claim 8, wherein duration of the second step is 2 AL, where AL denotes ½ of an acoustic resonance period of the channel.

12. The driving method of the droplet ejection head described in claim 6, wherein the second electric voltage pulse having the voltage level that prevents ejection of a droplet is applied onto every electrode formed on the sidewall regardless of whether the channel is a non-ejecting channel or an ejecting channel in the group of channels.

13. The driving method of the droplet ejection head described in claim 8, wherein the second electric voltage pulse having the voltage level that prevents ejection of a droplet is applied onto every electrode formed on the sidewall regardless of whether the channel is a non-ejecting channel or an ejecting channel in the group of channels.

14. The driving method of the droplet ejection head described in claim 6, wherein a maximum protruding amount of the meniscus by the application of the second electric voltage pulse having the voltage level that prevents ejection of droplet is not greater than a nozzle radius.

15. The driving method of the droplet ejection head described in claim 8, wherein a maximum protruding amount of the meniscus by the application of the second electric voltage pulse having the voltage level that prevents ejection of a droplet droplets is not greater than a nozzle radius.

16. The driving method of the droplet ejection head described in claim 1, wherein the electric voltage pulse is a rectangular wave pulse.

17. The driving method of the droplet ejection head described in claim 6, wherein the second electric voltage pulse is a rectangular wave pulse.

18. The driving method of the droplet ejection head described in claim 8, wherein the second electric voltage pulse is a rectangular wave pulse.

19. The driving method of the droplet ejection head described in claim 1, wherein viscosity of the liquid is not less than 5 cp and not greater than 15 cp.

20. The driving method of the droplet ejection head described in claim 6, wherein viscosity of the liquid is not less than 5 cp and not greater than 15 cp.

21. The driving method of the droplet ejection head described in claim 8, wherein viscosity of the liquid is not less than 5 cp and not greater than 15 cp.

22. The driving method of the droplet ejection head described in claim 1, wherein surface tension of the liquid is not less than 20 dyne/cm and not greater than 30 dyne/cm.

23. The driving method of the droplet ejection head described in claim 6, wherein surface tension of the liquid is not less than 20 dyne/cm and not greater than 30 dyne/cm.

24. The driving method of the droplet ejection head described in claim 8, wherein surface tension of the liquid is not less than 20 dyne/cm and not greater than 30 dyne/cm.

* * * * *